US008542987B2

(12) United States Patent
Yen

(10) Patent No.: US 8,542,987 B2
(45) Date of Patent: Sep. 24, 2013

(54) HEATER

(75) Inventor: Wen Chang Yen, Kaohsiung (TW)

(73) Assignee: Allgreen Designs Co., Ltd., Kaohsiung (TW)

( * ) Notice: Subject to any disclaimer, the term of this patent is extended or adjusted under 35 U.S.C. 154(b) by 106 days.

(21) Appl. No.: 13/176,203

(22) Filed: Jul. 5, 2011

(65) Prior Publication Data

US 2012/0263443 A1 Oct. 18, 2012

(30) Foreign Application Priority Data

Apr. 14, 2011 (TW) ..... 100206544 U

(51) Int. Cl.
*F24H 1/10* (2006.01)

(52) U.S. Cl.
USPC ..... 392/465; 126/92 R; 126/110 B; 126/59.5; 431/126; 432/209

(58) Field of Classification Search
USPC ..... 126/92, 92 B, 110 B, 92 R; 431/173, 431/328, 329, 326, 327; 392/465, 374, 354, 392/355, 356, 373; 219/530
See application file for complete search history.

(56) References Cited

U.S. PATENT DOCUMENTS 1,639,200 A * 8/1927 Pitts ..... 34/104
1,727,714 A * 9/1929 Kahn ..... 126/67
1,895,966 A * 1/1933 Bluemel ..... 126/111
1,942,936 A * 1/1934 Reznor ..... 126/90 R
1,958,331 A * 5/1934 Bell ..... 126/110 B
1,996,098 A * 4/1935 Chase ..... 431/146
2,240,224 A * 4/1941 Nance et al. ..... 431/342
2,863,978 A * 12/1958 Young ..... 392/355
3,545,425 A * 12/1970 Karpus et al. ..... 126/92 R
3,561,422 A * 2/1971 Colin-Smith ..... 126/92 B
3,868,944 A * 3/1975 Hobby ..... 126/59.5
3,881,863 A * 5/1975 Creuz ..... 432/222
4,013,396 A * 3/1977 Tenney ..... 431/11
4,035,137 A * 7/1977 Arand ..... 431/285
4,045,159 A * 8/1977 Nishi et al. ..... 431/328
4,063,876 A * 12/1977 Schweiss ..... 432/222
4,082,497 A * 4/1978 Crawford et al. ..... 431/158
4,421,102 A * 12/1983 Posnansky et al. ..... 126/647
4,524,753 A * 6/1985 Wolf ..... 126/99 R
4,964,394 A * 10/1990 Threatt ..... 122/14.31
5,524,606 A * 6/1996 Le Strat ..... 126/99 R
6,065,468 A * 5/2000 Willey et al. ..... 126/110 B
6,446,623 B1 * 9/2002 Resmo et al. ..... 126/92 R
6,550,470 B2 * 4/2003 Liang ..... 126/92 B
D474,532 S * 5/2003 Chan et al. ..... D23/336
6,792,937 B2 * 9/2004 Resmo et al. ..... 126/92 R
6,877,503 B1 * 4/2005 Hibshman et al. ..... 126/39 BA
6,880,549 B2 * 4/2005 Topp ..... 126/110 B (Continued)

*Primary Examiner* — Joseph M Pelham
*Assistant Examiner* — Jimmy Chou
(74) *Attorney, Agent, or Firm* — Kirschstein et al.

(57) ABSTRACT

A heater includes a base formed with a receiving space for receiving a fuel material that is to be combusted, and a heating unit. The heating unit includes: a flow guide component disposed on the top side of the base and having a through hole axially aligned and in communication with the opening, and at least one air passage communicated with the through hole and permitting air externally of the flow guide component to flow therethrough into the receiving space via the through hole and the opening; and a heat-radiating pipe disposed to extend upwardly from the flow guide component and disposed to surround the through hole and permitting flow of flue gas resulting from combustion of the fuel material in the receiving space therethrough.

10 Claims, 5 Drawing Sheets

(56) References Cited

U.S. PATENT DOCUMENTS

| | | | | |
|---|---|---|---|---|
| 7,086,396 | B2 * | 8/2006 | Waters | 126/92 B |
| 7,175,424 | B2 * | 2/2007 | Frink et al. | 431/126 |
| 7,278,418 | B2 * | 10/2007 | Duphily et al. | 126/92 B |
| D567,916 | S * | 4/2008 | McColgin et al. | D23/317 |
| 8,068,726 | B2 * | 11/2011 | Saunders et al. | 392/407 |
| 8,461,494 | B2 * | 6/2013 | Hall et al. | 219/536 |
| 2001/0037804 | A1 * | 11/2001 | Waters et al. | 126/92 AC |
| 2002/0023636 | A1 * | 2/2002 | Ashton et al. | 126/92 B |
| 2002/0088454 | A1 * | 7/2002 | Resmo et al. | 126/92 R |
| 2003/0029438 | A1 * | 2/2003 | Bossler | 126/92 B |
| 2003/0029439 | A1 * | 2/2003 | Bossler | 126/92 B |
| 2003/0041855 | A1 * | 3/2003 | Grady et al. | 126/519 |
| 2003/0056783 | A1 * | 3/2003 | Bossler | 126/92 AC |
| 2003/0136396 | A1 * | 7/2003 | Resmo et al. | 126/92 R |
| 2004/0011346 | A1 * | 1/2004 | Sakai | 126/92 AC |
| 2004/0177843 | A1 * | 9/2004 | Bernini et al. | 126/92 AC |
| 2004/0226551 | A1 * | 11/2004 | Duphily et al. | 126/92 B |
| 2004/0255927 | A1 * | 12/2004 | Johnson | 126/92 R |
| 2004/0261780 | A1 * | 12/2004 | Frink et al. | 126/92 B |
| 2005/0081623 | A1 * | 4/2005 | Frank | 73/295 |
| 2005/0147937 | A1 * | 7/2005 | Home | 431/354 |
| 2008/0006263 | A1 * | 1/2008 | Seichei et al. | 126/92 R |
| 2008/0178860 | A1 * | 7/2008 | Schwank et al. | 126/104 A |
| 2008/0202502 | A1 * | 8/2008 | Eckhardt | 126/92 AC |
| 2009/0050615 | A1 * | 2/2009 | Fis-Menache | 219/209 |
| 2009/0053664 | A1 * | 2/2009 | Staller et al. | 431/328 |
| 2010/0065047 | A1 * | 3/2010 | Wang | 126/92 AC |
| 2010/0243228 | A1 * | 9/2010 | Price | 165/185 |
| 2010/0248169 | A1 * | 9/2010 | Morgan et al. | 431/17 |
| 2010/0288268 | A1 * | 11/2010 | O'Connell et al. | 126/92 AC |
| 2010/0290765 | A1 * | 11/2010 | Lee | 392/485 |
| 2011/0073095 | A1 * | 3/2011 | Bechtold | 126/58 |
| 2011/0162632 | A1 * | 7/2011 | DiVentura | 126/58 |
| 2011/0283987 | A1 * | 11/2011 | Park et al. | 126/116 R |

* cited by examiner

HEATER

CROSS-REFERENCE TO RELATED APPLICATION

This application claims priority of Taiwanese application no. 100206544, filed on Apr. 14, 2011.

BACKGROUND OF THE INVENTION

1. Field of the Invention

This invention relates to a heating apparatus, more particularly to a heater involving fuel burning.

2. Description of the Related Art

As disclosed in Taiwan Utility Model Nos. M369436 and M302691, many conventional heaters usually utilize electricity to heat the ambient air to provide a warm place.

Although the method of heating the ambient air by utilizing electricity is relatively safe and convenient, it has the following disadvantages:

1. The environment suitable for application of the heater is limited: utilization of electricity as an energy source is convenient, but use of the heater is contrarily limited by the electricity supply. Thus, the electric heater is not suitable for use in places with no or insufficient electricity supply, such as outdoors.

2. Electrical load is relatively heavy: more power is required for the heater that utilizes electricity as the energy source, and thus, a power outage may occur due to an overloaded circuit if a lot of heaters operate at the same time.

SUMMARY OF THE INVENTION

Therefore, an object of the present invention is to provide a heater which can be widely used and will not cause electricity overload.

According to this invention, there is provided a heater comprising:

a base formed with a receiving space for receiving a fuel material that is to be combusted, the base having a top side formed with an opening that is in communication with the receiving space; and a heating unit including a flow guide component disposed on the top side of the base and having a through hole axially aligned and in communication with the opening, and at least one air passage communicated with the through hole and permitting air externally of the flow guide component to flow therethrough into the receiving space via the through hole and the opening, the air passage having an inlet end distal from the through hole and a connecting end in communication with the through hole, the air passage further having a width that is gradually reduced from the inlet end to the connecting end, and a heat-radiating pipe disposed to extend upwardly from the flow guide component and disposed to surround the through hole, the heat-radiating pipe permitting flow of flue gas resulting from combustion of the fuel material in the receiving space therethrough.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
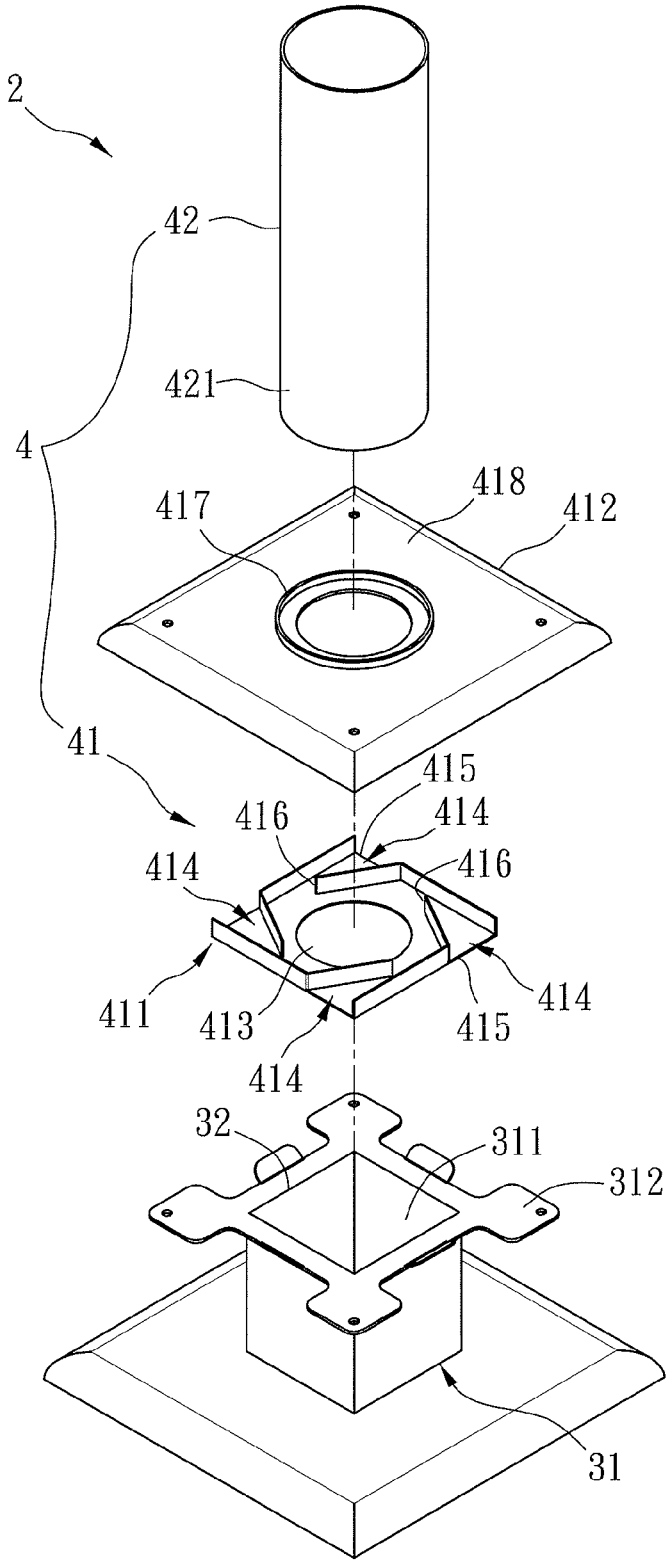
FIG. 1 is an exploded perspective view of the first preferred embodiment of a heater according to the present invention.

Before the present invention is described in greater detail with reference to the accompanying preferred embodiments, it should be noted herein that like elements are denoted by the same reference numerals throughout the disclosure.

Referring to FIG. 1, the heater 2 according to the first preferred embodiment of the present invention comprises a base 31 and a heating unit 4.

Figure 2:
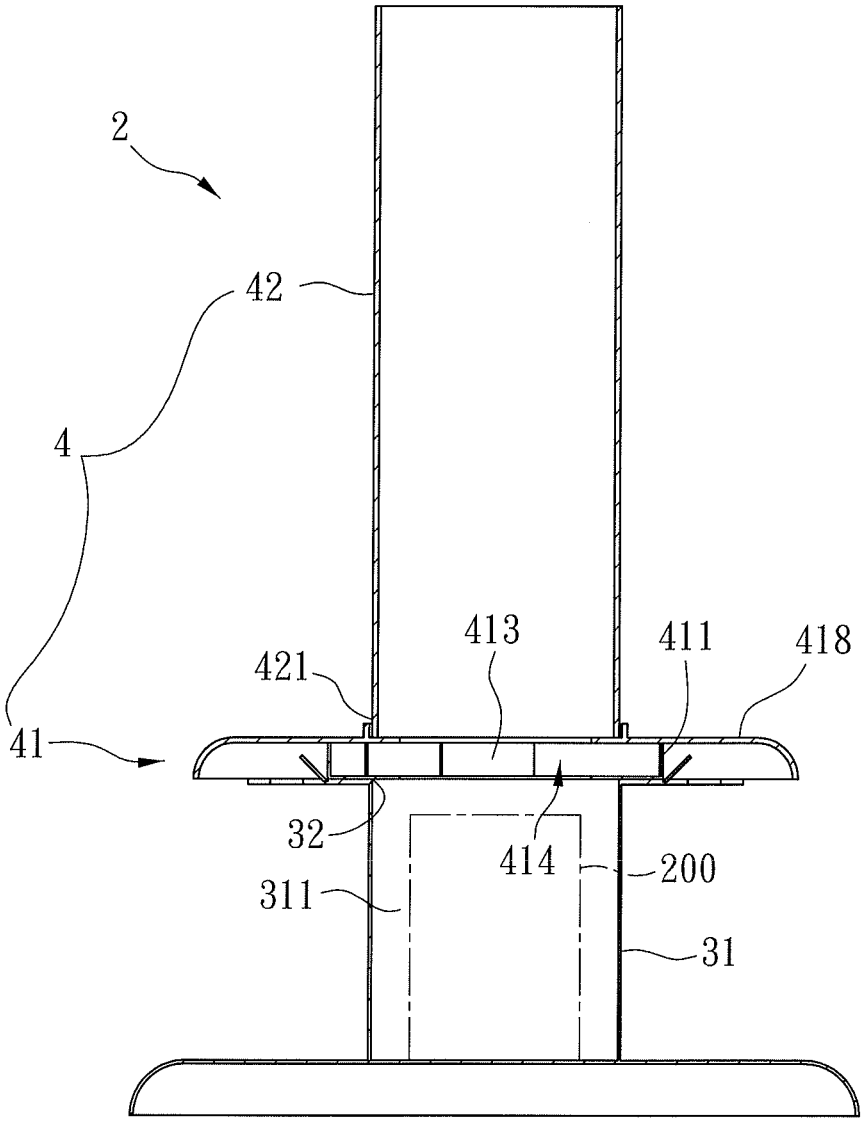
FIG. 2 is a cross-sectional view of the first preferred embodiment of FIG. 1.
Figure 3:
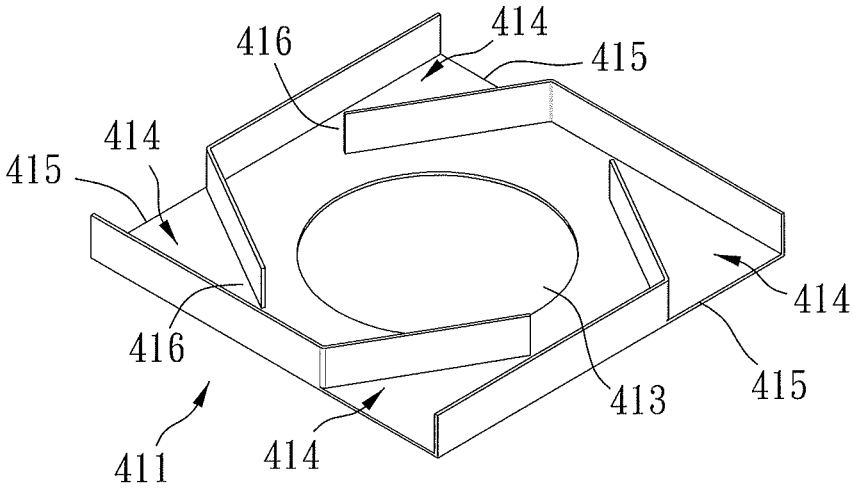
FIG. 3 is a perspective view illustrating a flow guide component of the first preferred embodiment of the heater of the present invention.

Further referring to FIGS. 2 and 3, the base 31 is formed with a receiving space 311 for receiving a fuel material 200 that is to be combusted. The base 31 has a top side 312 formed with an opening 32 that is in communication with the receiving space 311.

The heating unit 4 includes a flow guide component 41 and a heat-radiating pipe 42. The flow guide component 41 is disposed on the top side 312 of the base 31 and has a through hole 413 and at least one air passage 414. The through hole 413 is axially aligned and in communication with the opening 32. The at least one air passage 414 is communicated with the through hole 413 and permits air externally of the flow guide component 41 to flow therethrough into the receiving space 311 via the through hole 413 and the opening 311.

In this preferred embodiment, the air passage 414 has an inlet end 415 distal from the through hole 413 and a connecting end 416 in communication with the through hole 413. The air passage 414 further has a width that is gradually reduced from the inlet end 415 to the connecting end 416.

The heat-radiating pipe 42 is disposed to extend upwardly from the flow guide component 41 and is disposed to surround the through hole 413. The heat-radiating pipe 42 permits flow of flue gas resulting from combustion of the fuel material 200 in the receiving space 311 therethrough. Preferably, the heat-radiating pipe 42 is a quartz glass pipe.

Preferably, the flow guide component 41 includes a main body part 411 disposed on the top side 312 of the base 31 and a covering part 412 disposed on the main body part 411. The through hole 413 is formed axially through the main body part 411 and the covering part 412. The air passage 414 may be defined by at least one of the main body part 411 and the covering part 412. In this preferred embodiment, the flow guide component 41 includes four air passages 414, and each of the four air passages 414 is defined by the main body part 411.

Additionally, the covering part 412 has a top side 418 formed with a retainer ring 417 that surrounds the through hole 413. The heat-radiating pipe 42 has at least one end 421 that is retained at the retainer ring 417.

To use the heater 2, the fuel material 200, such as alcohol paste, kerosene, etc. is accommodated in the receiving space 311. Once the fuel material 200 is combusted, the heat generated from the combustion of the fuel material 200 will diffuse outwardly through the heat-radiating pipe 42 to increase the ambient temperature and to warm up the environment. Since, in the heater 2 of this invention, the heat energy is generated from the combustion of the fuel material 200 instead of electricity, it can be widely used even in places without electricity supply or with tight electricity supply and can reduce electricity consumption.

Furthermore, when the heater 2 is in use, the convective flow of hot air passing upwardly along the heat-radiating pipe 42 induces a vacuum effect. Hence, when the fuel material 200 in the receiving space 311 is ignited, the vacuum effect tends to simultaneously cause the ambient air to be introduced to the receiving space 311 through the air passages 414 and the through hole 413. By means of the geometric design of the air passages 414 that have a width that is gradually reduced from the inlet end 415 to the connecting end 416, the introduced ambient air is pressurized to form a concentrated flow. When the introduced ambient air flows into the through hole 413 through the connecting ends 416 of the air passages 414, a turbulent flow of the introduced ambient air is generated so as to facilitate complete combustion of the fuel material 200, and so as to interact with the convective flow of the hot air passing upwardly along the heat-radiating pipe 42 to enhance a visually aesthetic feeling through formation of spiral flames.

Additionally, in the preferred embodiment shown in FIG. 3, the main body part 411 of the flow guide component 41 has a substantially rectangular shape and can be conveniently formed through sheet metal processing so as to simplify processing procedures and to reduce production cost.

Figure 5:
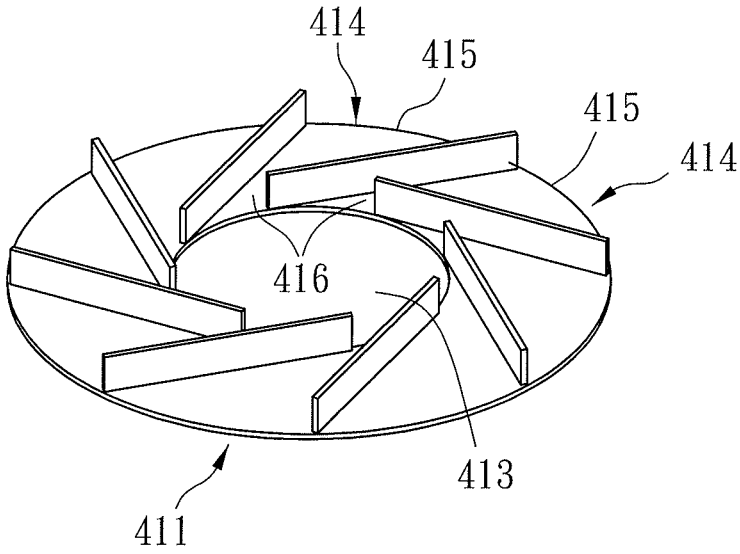
FIGS. 5 and 6 are perspective views illustrating other types of flow guide components suitable for use in the heater of the present invention.
Figure 6:
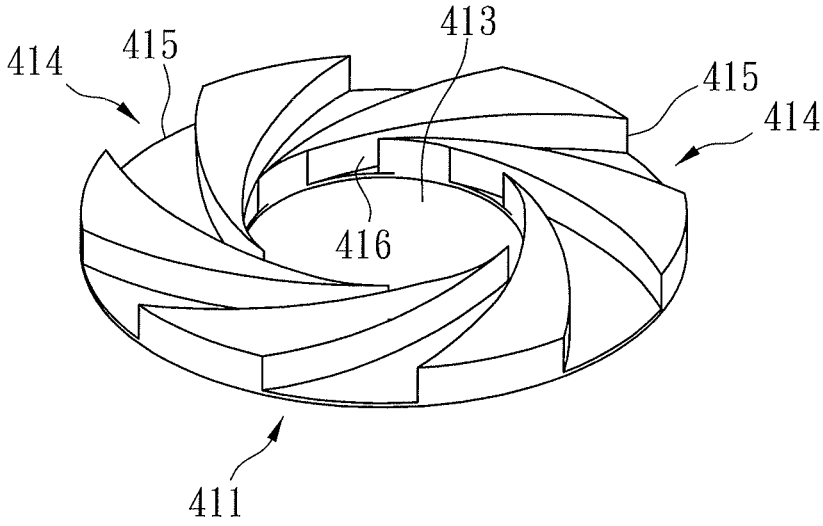

Referring to FIGS. 5 and 6, the main body part 411 of the flow guide component 41 may have other configurations, such as a substantially round shape, and is not limited to the rectangular shape shown in FIG. 3. The air passages 414 may also have other geometric designs as long as the air passages 414 have a width that is gradually reduced from the inlet end 415 to the connecting end 416 in order to achieve the same effects of concentrating the introduced ambient air and improving visually aesthetic feeling.

Figure 4:
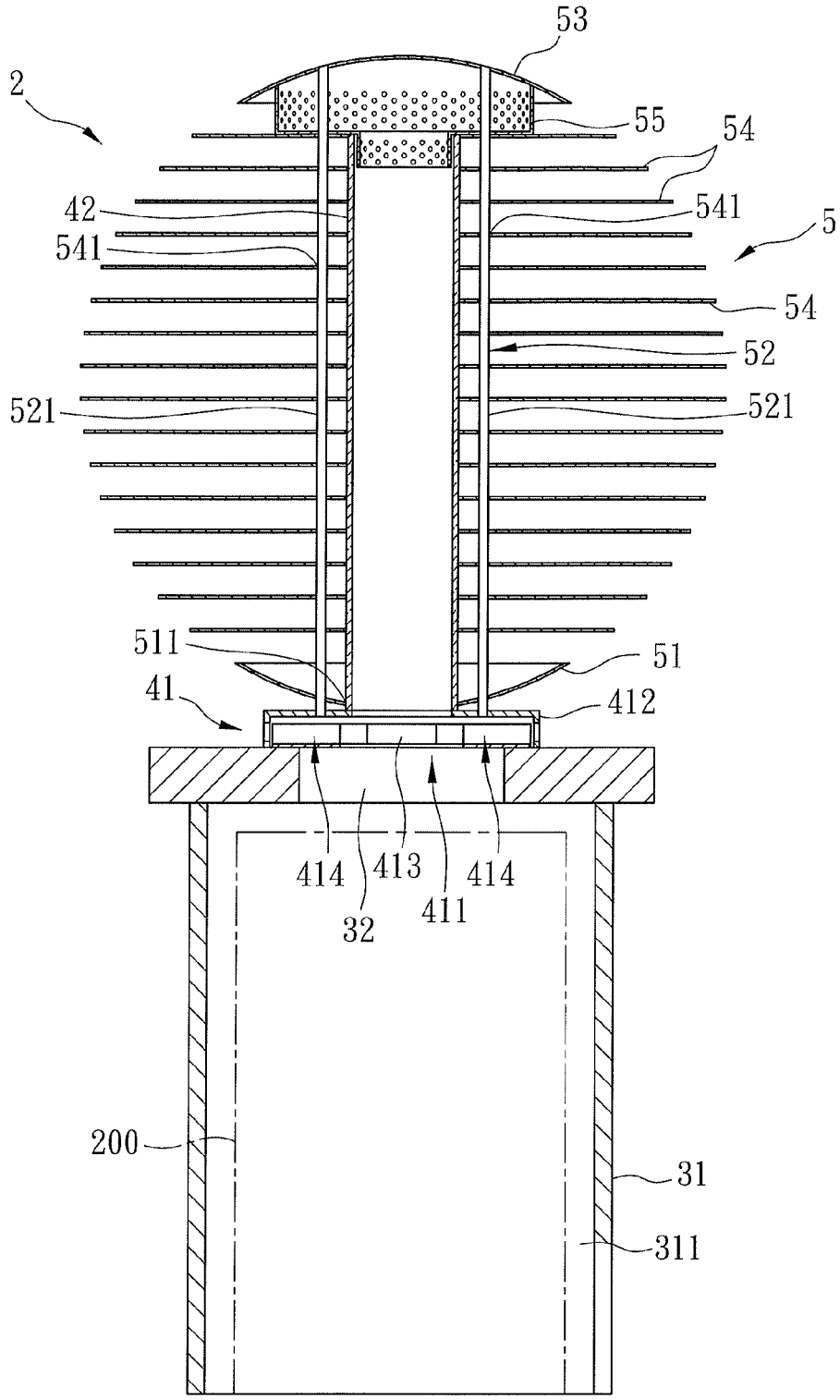
FIG. 4 is a cross-sectional view of the second preferred embodiment of a heater according to the present invention.

Referring to FIG. 4, the second preferred embodiment of a heater according to the present invention is illustrated. The second embodiment differs from the first embodiment only in that the heater 2 further comprises a heat-dissipating unit 5. The heat-dissipating unit 5 includes a base member 51, a support structure 52 and a plurality of heat-dissipating plates 54. The base member 51 is disposed on top of the covering part 412 and is formed with a pipe hole 511 that permits extension of the heat-radiating pipe 42 therethrough. The support structure 52 extends upwardly from the base member 51. The plurality of heat-dissipating plates 54 are mounted at intervals on the support structure 52. Preferably, the support structure 52 includes a plurality of support rods 521 that surround the heat-radiating pipe 42. Each of the heat-dissipating plates 54 has a plurality of rod connection parts 541 connected to the support rods 521, respectively. More preferably, the heat-dissipating unit 5 further includes a cowl 53 and a perforated hollow coupler 55. The cowl 53 is disposed above the heat-radiating pipe 42 and is connected to one end of the support structure 52 opposite to the base member 51. The perforated hollow coupler 55 interconnects the cowl 53 and the heat-radiating pipe 42. The cowl 53 can prevent foreign matter from falling into the heat-radiating pipe 42.

Similar to the first preferred embodiment shown in FIGS. 1-3, in this embodiment, the heater 2 can be widely used even in places without electricity supply or with tight electricity supply, and the turbulent flow of the introduced ambient air can be generated to facilitate completer combustion of the fuel material 200, and to enhance a visually aesthetic feeling through formation of spiral flames. Besides, the heat-dissipating plates 54 cooperate with the base member 51 and the cowl 53 to form the heat-dissipating unit 5 with a spherical appearance. However, the heat-dissipating unit 5 is not limited to the disclosure in this embodiment, and can be formed in other configurations, such as by changing arrangement of the heat-dissipating plates 54.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A heater comprising:

a base formed with a receiving space for receiving a fuel material that is to be combusted, said base having a top side formed with an opening that is in communication with said receiving space; and a heating unit including a flow guide component disposed on said top side of said base and having a through hole that is axially aligned and in direct communication with said opening and that has a diametrical dimension smaller than that of said opening, and a plurality of angularly spaced apart spiral air passages disposed around said through hole to permit air externally of said flow guide component to flow therethrough into said through hole, each of said air passages having an inlet end distal from said through hole and a connecting end disposed in proximity to and in communication with said through hole, each of said air passages further having a width that is gradually reduced from said inlet end to said connecting end, and a heat-radiating pipe disposed to extend upwardly from said flow guide component and disposed directly above said through hole, said heat-radiating pipe having a diametrical dimension larger than that of said through hole and permitting flow of flue gas resulting from combustion of the fuel material in said receiving space therethrough.

2. The heater as claimed in claim 1, wherein said heat-radiating pipe is a quartz glass pipe.

3. The heater as claimed in claim 1, wherein said flow guide component includes a main body part disposed on said top side of said base and a covering part disposed on said main body part, said through hole being formed axially through said main body part and said covering part, said air passages being defined by at least one of said main body part and said covering part.

4. The heater as claimed in claim 3, wherein said covering part has a top side formed with a retainer ring that surrounds said through hole, said heat-radiating pipe having one end that is retained at said retainer ring.

5. The heater as claimed in claim 3, further comprising a heat-dissipating unit including a base member disposed on top of said covering part and formed with a pipe hole that permits extension of said heat-radiating pipe therethrough;

a support structure that extends upwardly from said base member; and a plurality of heat-dissipating plates mounted at intervals on said support structure.

6. The heater as claimed in claim 5, wherein said support structure includes a plurality of support rods that surround said heat-radiating pipe, each of said heat-dissipating plates having a plurality of rod connection parts connected to said support rods, respectively.

7. The heater as claimed in claim 5, wherein said heat-dissipating unit further includes a cowl disposed above said heat-radiating pipe and connected to one end of said support structure opposite to said base member.

8. The heater as claimed in claim 7, wherein said heat-dissipating unit further includes a perforated hollow coupler that interconnects said cowl and said heat-radiating pipe.

9. A heater comprising:

a base formed with a receiving space for receiving a fuel material that is to be combusted, said base having a top side formed with an opening that is in communication with said receiving space; and a heating unit including a flow guide component disposed on said top side of said base and having a through hole that is axially aligned and in direct communication with said opening, and a plurality of angularly spaced apart spiral air passages disposed around said through hole to permit air externally of said flow guide component to flow therethrough into said through hole, each of said air passages having an inlet end distal from said through hole and a connecting end proximal to and in communication with said through hole, each of said air passages further having a width that is gradually reduced from said inlet end to said connecting end, and a heat-radiating pipe disposed to extend upwardly from said flow guide component and disposed directly above said through hole, said heat-radiating pipe permitting flow of flue gas resulting from combustion of the fuel material in said receiving space therethrough.

10. A heater comprising:

a base formed with a receiving space for receiving a fuel material that is to be combusted, said base having a top side formed with an opening that is in communication with said receiving space; and a heating unit including a flow guide component disposed on said top side of said base and having a through hole that is axially aligned and in direct communication with said opening and that has a diametrical dimension smaller than that of said opening, and at least one spiral air passage disposed around said through hole to permit air externally of said flow guide component to flow therethrough into said through hole, said air passage having an inlet end distal from said through hole and a connecting end proximal to and in communication with said through hole, said air passage further having a width that is gradually reduced from said inlet end to said connecting end, and a heat-radiating pipe disposed to extend upwardly from said flow guide component and disposed directly above said through hole, said heat-radiating pipe having a diametrical dimension larger than that of said through hole and permitting flow of flue gas resulting from combustion of the fuel material in said receiving space therethrough.

* * * * *